US007472564B2

(12) United States Patent
Bolzt et al.

(10) Patent No.: US 7,472,564 B2
(45) Date of Patent: Jan. 6, 2009

(54) NECKLACE OR BRACELET WITH REGULARLY SPACED LINKS ON A FLEXIBLE CONNECTING MEMBER.

(75) Inventors: Sébastien Bolzt, Neuchâtel (CH); Domenico Leo, Bévilard (CH); David Apotheloz, Corcelles (CH)

(73) Assignee: The Swatch Group Management Services AG, Biel (CH)

( * ) Notice: Subject to any disclaimer, the term of this patent is extended or adjusted under 35 U.S.C. 154(b) by 234 days.

(21) Appl. No.: 11/423,508

(22) Filed: Jun. 12, 2006

(65) Prior Publication Data

US 2006/0277945 A1 Dec. 14, 2006

(30) Foreign Application Priority Data

Jun. 10, 2005 (EP) ..... 05012513

(51) Int. Cl.
*A44C 5/00* (2006.01)

(52) U.S. Cl. ..... 63/38; 63/3; 63/26

(58) Field of Classification Search ..... None
See application file for complete search history.

(56) References Cited

U.S. PATENT DOCUMENTS 878,122 A * 2/1908 Costello ..... 63/4
4,237,702 A * 12/1980 Caverly ..... 63/3.2
6,220,010 B1 * 4/2001 Gomez ..... 59/80
6,557,376 B2 * 5/2003 Pratt ..... 63/3
6,901,771 B2 * 6/2005 Ooide ..... 63/26
2002/0148250 A1 * 10/2002 Pratt ..... 63/3
2003/0154742 A1 * 8/2003 Ooide ..... 63/38

FOREIGN PATENT DOCUMENTS

| | | |
|---|---|---|
| CH | 482 420 | 1/1970 |
| CH | 490 827 | 7/1970 |
| CH | 515 005 | 12/1971 |
| EP | 0 167 891 | 1/1986 |
| FR | 2036330 | 12/1970 |
| FR | 1603836 | 7/1971 |

OTHER PUBLICATIONS

European Search Report issued in corresponding application No. EP 05012513 completed Dec. 21, 2005.

* cited by examiner

*Primary Examiner*—Jack W. Lavinder
(74) *Attorney, Agent, or Firm*—Griffin & Szipl, P.C.

(57) ABSTRACT

The links (1) are formed by a set of parts (3, 4, 6, 9, 15) including at least two caps (3, 4) including, on the one hand, means for assembling (13, 14, 15) their feet (3*b*, 4*b*) to hold, between their heads (3*a*, 4*a*) a decorative casing element (9), and on the other hand, locking means (6, 16) at the junction of their feet (3*b*, 4*b*) for immobilising each link (1) on the connecting member. The preferred embodiment includes a rigid tube (15) assembling the feet (3*b*, 4*b*) and holding a deformable insert locking the connecting member.

17 Claims, 6 Drawing Sheets

NECKLACE OR BRACELET WITH REGULARLY SPACED LINKS ON A FLEXIBLE CONNECTING MEMBER.

This application claims priority from European Patent Application 05012513.7 filed Jun. 10, 2005, the entire disclosure of which is incorporated herein by reference.

FIELD OF THE INVENTION

The invention concerns a necklace or a bracelet with regularly spaced links on a flexible connecting member.

It is an object of the present invention to propose a fanciful article having a pleasing appearance that can easily be altered to adapt to fashion trends and that has a low cost price and whose size can easily be adjusted.

BACKGROUND OF THE INVENTION

Various devices, particularly in the watch making field, allow a set of decorative elements to be assembled on a flexible connecting member, for example to form a watch bracelet or a necklace. Links are then arranged in accordance with different variants to form a more or less rigid hinged assembly.

In the technical field, various devices concern links that are hinged to each other to form a bracelet or necklace but these devices, based on the principle of hinging links to each other, do not allow said links to be spaced along the assembly element because of the necessary juxtaposition of the elements.

A bracelet composed of links connected to each other using pins is known, there also exist links in the form of a frame, like that disclosed in FR Patent No. 1 603 836 and several examples of this design for necklaces or bracelets in which the links are arranged in relation to each other via more or less sophisticated hinges and linking parts.

Since the complexity of this type of hinge has been the cause of numerous problems during use, the use of one or several flexible connecting members, which generally pass through the links, has been envisaged, in order to overcome this difficulty. Such systems are disclosed for example in CH Patent Nos. 490 827 and 482 420.

In the field of jewellery, the use of a connecting member passing through decorative elements or jewels, which are then simply threaded on one after the other, is well known. When there is an insufficient number of elements, i.e. they cannot be juxtaposed, this arrangement results in unevenly distributed empty spaces and to an inelegant assembly when the necklace or bracelet is worn by the user.

It is indispensable for the decorative elements to be held on the flexible connecting member if a chain configuration with preserved empty spaces is desired, i.e. in the situation in which the links or decorative elements are not juxtaposed to form a continuous assembly. This arrangement can be desired when the decorative elements are voluminous or when, for example, the decorative part of the links changes from one element to the next.

A first problem to be overcome thus consists in the possibility of arranging links along a necklace or bracelet in a discontinuous manner with the possibility of keeping said links in predefined positions.

The arrangement of elements on a flexible connecting member is known wherein the elements are hinged to each other in a complex manner, for example by snap fit, such as disclosed in FR Patent No. 2 036 330.

Bracelets have also been proposed wherein one or several flexible connecting members pass through links and are held by the pinching or deformation of the element itself, as illustrated in CH Patent No. 515 005.

EP Patent No. 167 891 relating to a wristwatch including a plurality of elements hinged to each other, and wherein the links comprise two longitudinal channels for the passage of flexible connecting members, has a similar assembly and holding design to that cited previously.

A method of securing decorative elements to a flexible connecting member by means of locking screws passing through said elements has also been disclosed. This device allows the links perfect freedom of movement in relation to each other but employs a large number of small parts that are difficult to assembly on an industrial scale.

Study of the prior art shows that several devices overcome this known problem of spacing links or decorative elements along a flexible connecting member, however, the systems usually have the major drawback of making it difficult, or impossible, to replace the assembled elements and of complicating both adjustment of the length of the assembly and positioning the individual elements longitudinally.

From an aesthetic point of view, control of the linking and localisation of the elements is frequently desired, for example for jewellery necklaces. One could for example envisage placing a juxtaposed set of pearls, then an empty space, a black pearl, an empty space, another jewel, and again a set of pearls, to form original series of links.

A second problem consists thus in making an assembly whose individual elements are easy to arranged, and particularly maintaining the possibility of empty spaces along the necklace or bracelet, between the links, while ensuring that said links are immobilised in their allocated position.

In known bracelet and necklace manufacturing techniques the various attempts to overcome the preceding problems have led to complex solutions that are often difficult to implement. A third, economical, problem is raised as regards the mass production of such bracelets or necklaces. The ability to produce technically simple links for the lowest possible cost price is a deciding factor.

Currently in the field of jewellery or watch making, the decorative parts covering the parts or assemblies produced are difficult to alter. A fourth problem is linked to the ease with which the decorative parts carried by the links can be replaced in order to adapt them to fashion and the user's convenience, whether this is carried out by users or during manufacture.

Said decorative parts and the hinged link assembly on a flexible connecting member must also answer the necessary criteria of solidity and durability during extended use of the necklace or bracelet.

SUMMARY OF THE INVENTION

It is thus an object of the present invention, which therefore consists of a necklace or a bracelet including links and a flexible connecting member, to overcome these main difficulties.

Each link is therefore formed by a set of pieces comprising at least two caps traversed by a channel for receiving the connecting member and a decorative part element held between the heads of the caps, said caps comprising, on the one hand means for assembling their feet preferably without exerting mechanical stresses on the decorative part, and on the other hand locking means at the junction of their feet for immobilising each link at a chosen location on the connecting member.

The caps can be assembled by means of a complementary male and female parts provided in their feet. They can also be assembled by means of an intermediate rigid tube surrounding their feet, said tube itself being surrounded by the decorative part or being able to form said decorative part.

The locking means can be formed by a particular arrangement of the feet or by inserting an insert exerting a compressive force on the connecting member or, conversely, allowing an elastomeric part of the connecting member to expand.

A bracelet or a necklace according to the invention has multiple advantages in relation to the known prior art:

The links can be positioned at will along the flexible connecting member forming a support, and particularly with spaces left free, without any risk of sliding. Various decorative parts carried by the links can thus be arranged with regular spacing without insertion of an intermediate piece.

The links being not hinged with respect to each other, the bracelet on the collar has a high flexibility.

Because of the great ease with which the links are locked and unlocked, the number and position of the links can easily be adjusted.

The manufacture of various constituent elements of the links and the assembly of the bracelet or necklace can be achieved at a modest cost price, which essentially takes into account, for the overall cost paid by the client, the cost of the casing.

The great ease of assembly and alteration of the set of links allows the casing to be altered in accordance with fashion or users' taste, and one could even envisage said users making bracelets or necklaces to their liking after acquiring the constituent elements of various links and decorative parts.

BRIEF DESCRIPTION OF THE DRAWINGS

Other features and advantages of the invention will appear from the following description of various embodiment examples, with reference to the annexed drawings, in which.

DETAILED DESCRIPTION OF THE INVENTION

Figure 1:
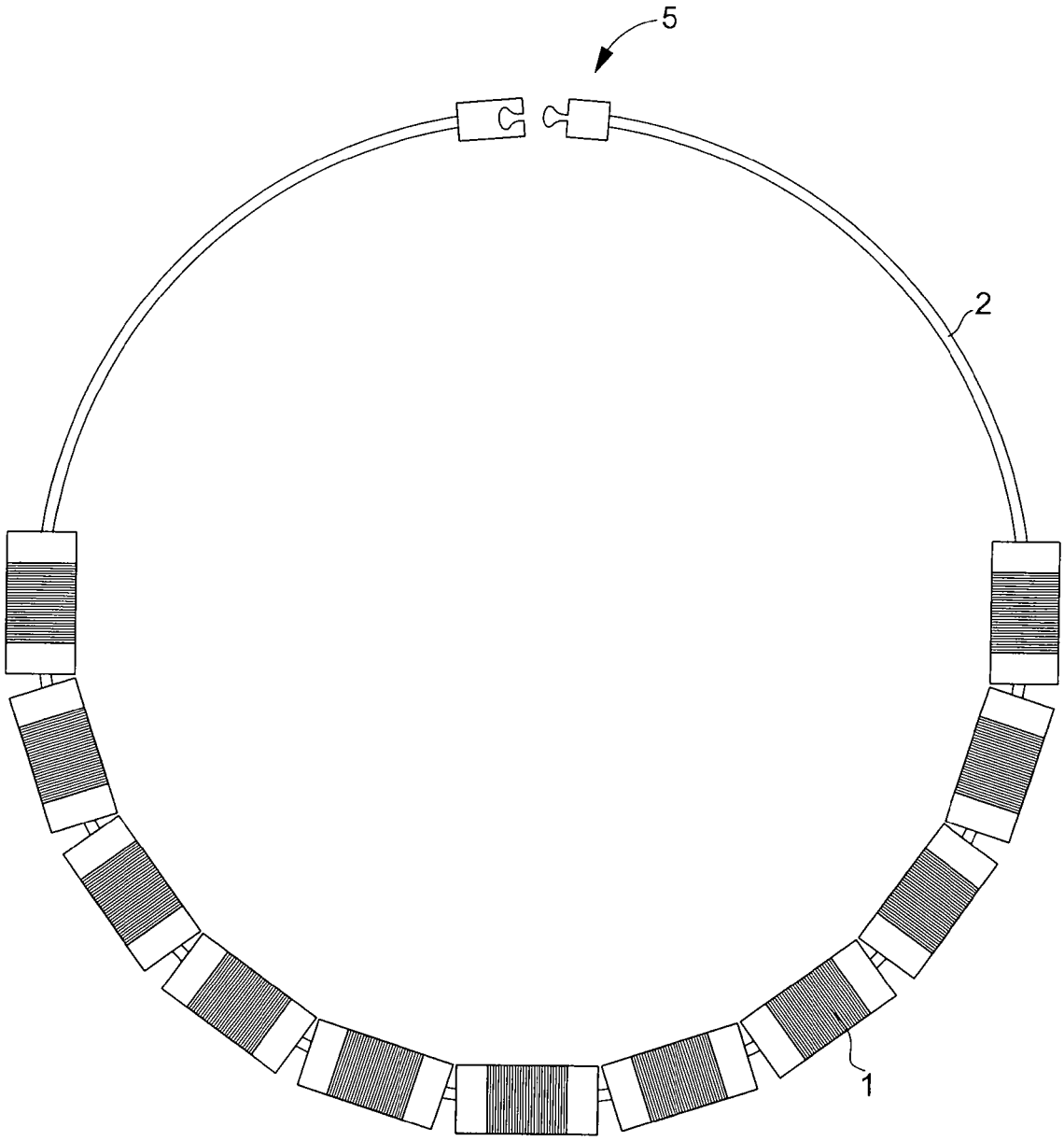
FIG. 1 is an overall view of a necklace according to the invention.

FIG. 1 shows a necklace comprising links 1 arranged on a flexible connecting member 2, closed by a clasp 5. In this example, the links are contiguous at an angle, but it could be envisaged, within the scope of the invention, to place the links further apart from each other.

FIGS. 2 to 5 describe in more detail various variants of a first embodiment concerning in particular a first means of assembling links 1 on a flexible connecting member 2.

In the following description, a "flexible connecting member" means any connecting member able to bear a certain curvature to form, without breaking, a necklace or a bracelet comprising a clasp 5.

Figure 2:
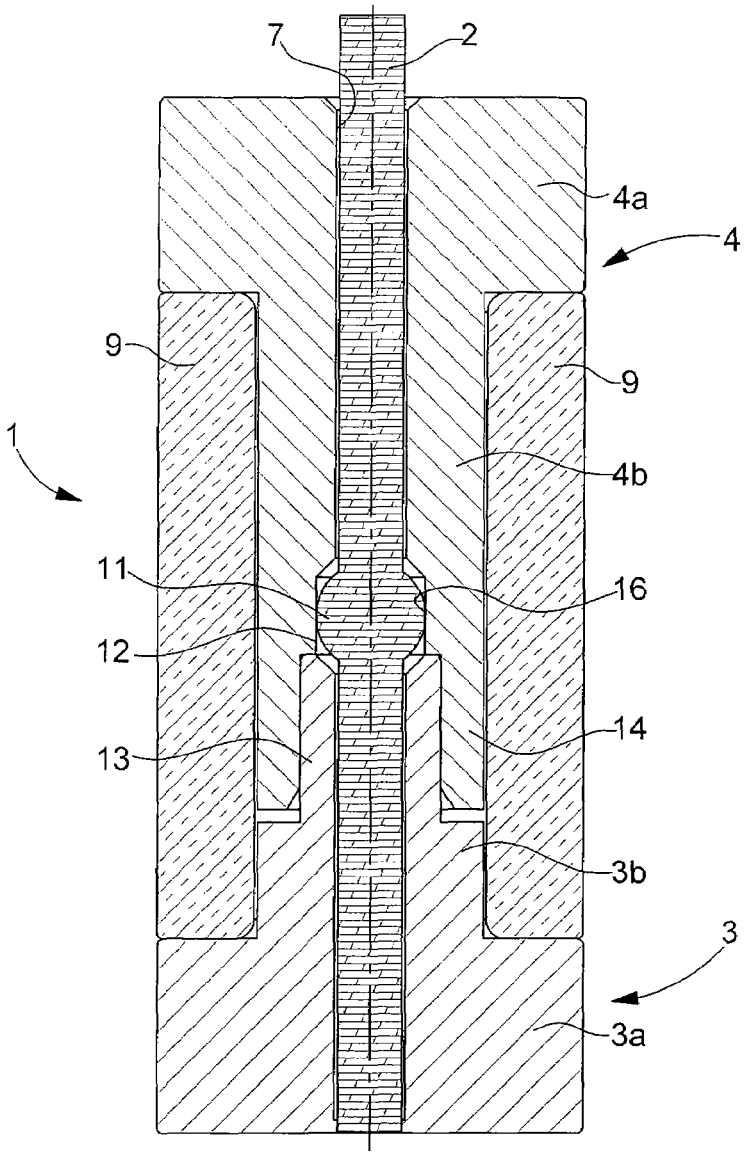
FIG. 2 is a cross-section of a link according to a first embodiment of the invention.

As can be seen in the first variant shown in FIG. 2, link 1 is formed of only three pieces, namely two caps 3, 4, comprising heads 3*a*, 4*a*, whose section is greater than feet 3*b*, 4*b*, traversed by a channel 7 for the passage of connecting member 2 with friction or with play. The shoulders formed between heads 3*a*, 4*a* and feet 3*b*, 4*b* of the two caps 3, 4, which are T shaped, hold a decorative part 9 when caps 3, 4 are secured by feet 3*b*, 4*b*. In this first embodiment, feet 3*b*, 4*b* are designed with complementary male 13 and female 14 parts.

Complementary male and female parts 13, 14 are assembled in a known manner in the zones where they overlap, for example by bonding, driving in, snap fit, screwing or by a bayonet device. Driving in is the preferred embodiment, since the manufacture of caps 3, 4 is simpler and more economical, while still allowing disassembly to replace one decorative part 9 with another.

Figure 4A:
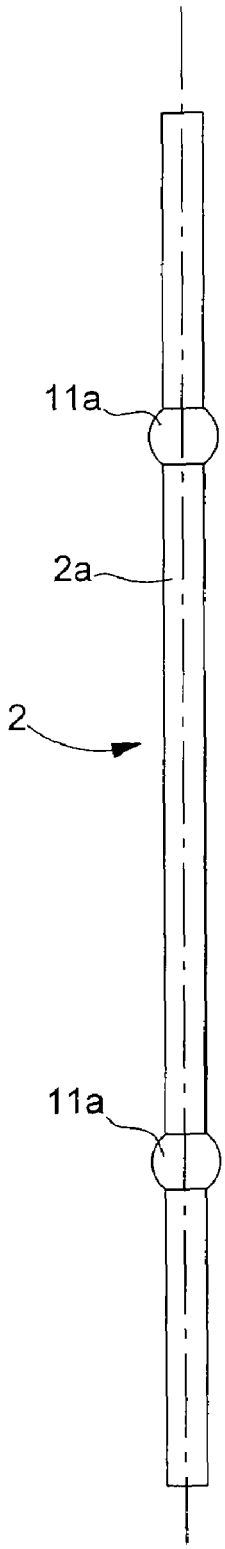
FIGS. 4A and 4B show various embodiments of flexible connecting members that can be used in accordance with the invention.
Figure 4B:
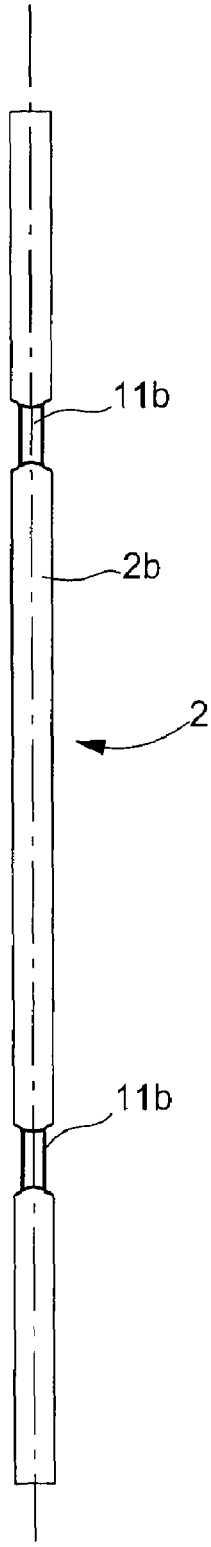

In this first variant, the locking means consist simply of a space 16 formed in the bottom of female part 14 and having a slightly larger section than the section of channel 7 for the passage of a flexible connecting member 2 shown in FIGS. 4A and 4B.

FIG. 4A shows a first embodiment of connecting member 2 which includes a core 2*a* that cannot be deformed, for example made of steel, on which elastomeric balls 11*a* have been over moulded. These elastomeric balls 11*a* can be compressed in channel 7 and expand again in space 16 to lock a link 1.

FIG. 4B shows a second embodiment of connecting member 2 which then comprises a deformable core 2*b* in which "discs" 11*b* are formed by crushing, said discs extending beyond the section of connecting member 2. The discs can, as previously, be compressed in channel 7 and expand again in space 16.

Figure 2A:
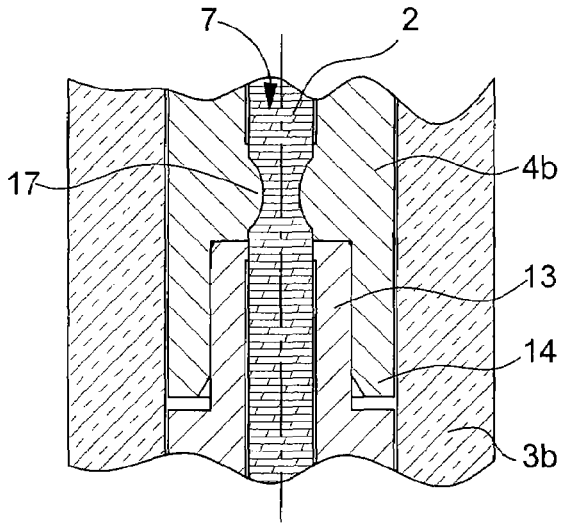
FIG. 2A shows other locking means of the link shown in FIG. 2.

It is also possible to use a flexible connecting member 2 that has neither a bulge 11*a*, nor crushed deformation 11*b*, provided that said connecting member has a deformable external sheath. The means for locking link 1 on connecting member 2 are then those shown in FIG. 2A. As can be seen, close to its inner end, channel 7 of female cap 4 has a narrow portion 17 which allows connecting member to be pinched. In an equivalent manner, narrow portion 17 can be provided close to the inner end of cap 3. It is even possible to provide an harrow portion 17 close to the ends of the two caps 3, 4, which helps to reinforce, or replace, the means for assembling the two caps could then simply be assembled by friction.

Figure 3:
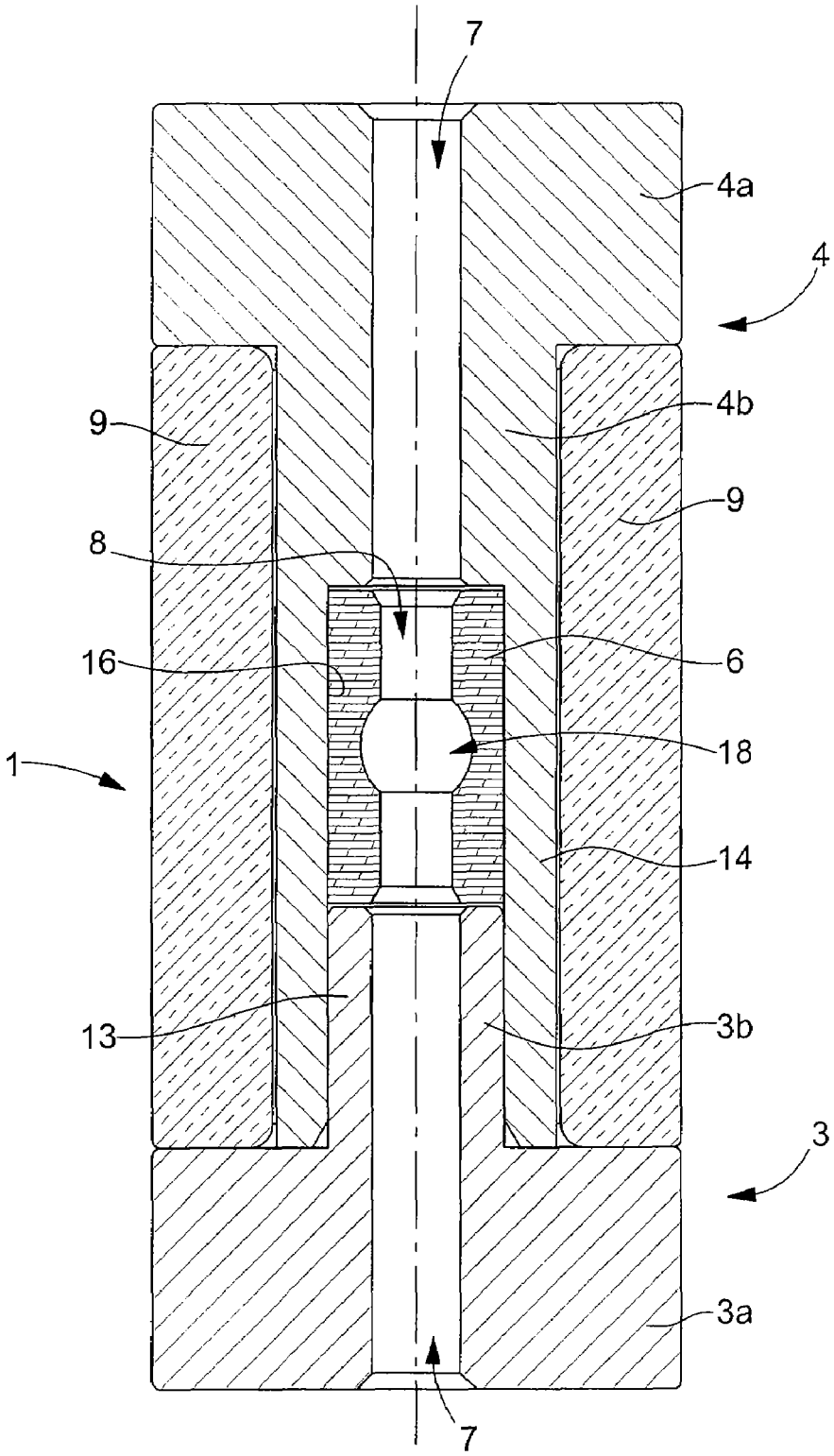
FIG. 3 is a cross-section of a link according to a variant of the first embodiment.

With reference now to FIG. 3, a variant of the first embodiment is shown comprising an additional part. It can be seen that space 16, between the bottom of female part 14 and the end of male part 13 houses an insert 6. Insert 6 includes along the axis of channels 7 a through passage 8 having in its substantially median part a recess 18. Recess 18 has the same function as space 16 in the embodiment previously described and locks the links on connecting members of the type shown in FIGS. 4A and 4B. Insert 6, which will not be visible once the link has been assembled, can for example be manufactured by injection moulding a rigid plastic material. In such case, channels 7 can have a substantially equal section to that of over moulded parts 11*a* or deformed parts 11*b* of connecting member 2, and through passage 8 can have a slightly smaller section to allow forced passage as far as recess 18.

Figure 5:
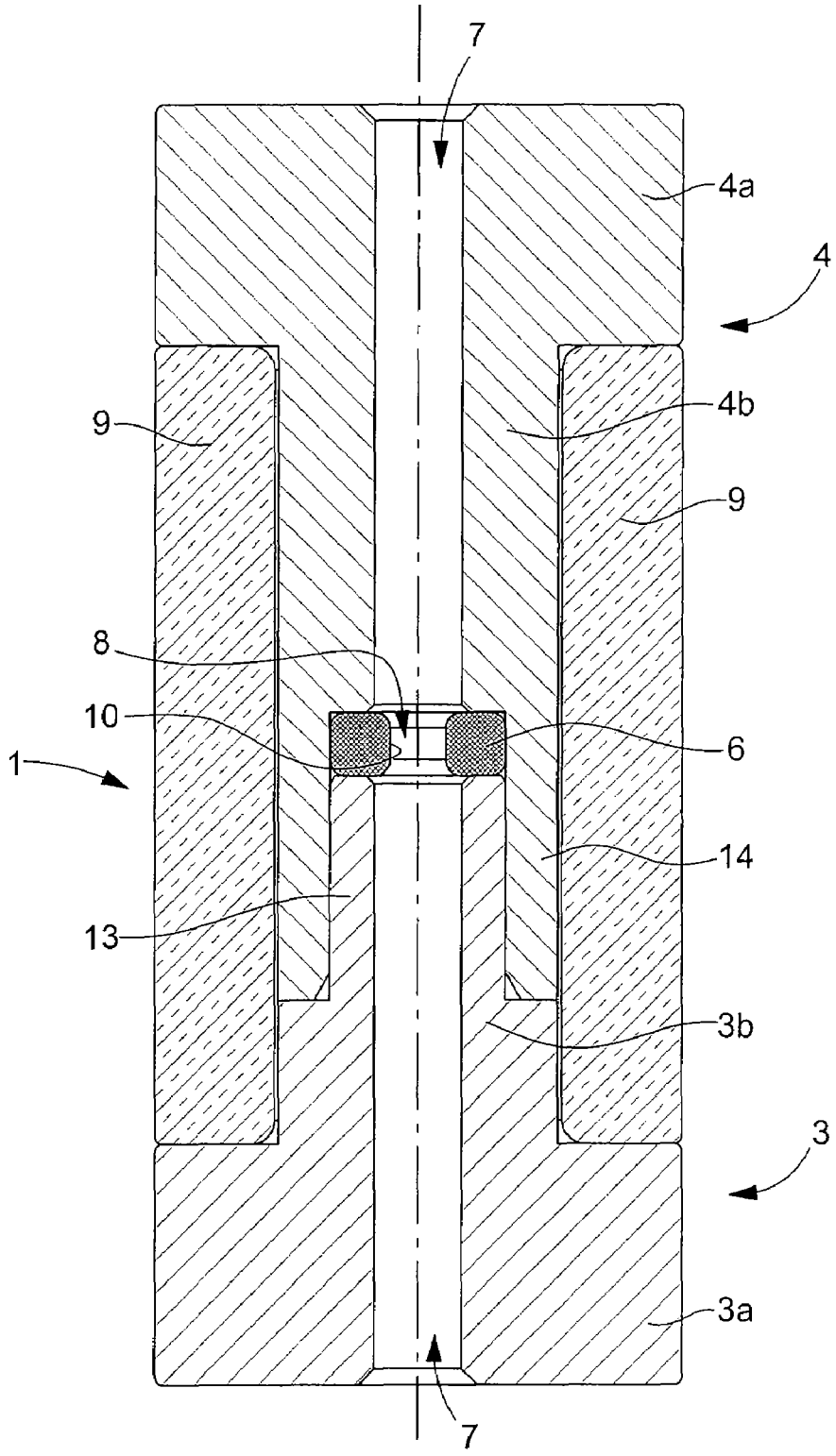
FIG. 5 is a cross-section of a link according to a second variant of the first embodiment.

FIG. 5 shows another variant wherein insert 6, made of a deformable material such as an elastomer, has a narrow portion 10 smaller than the section of connecting member 2. This embodiment allows the user to choose the space that he wishes between each link 1.

Figure 6:
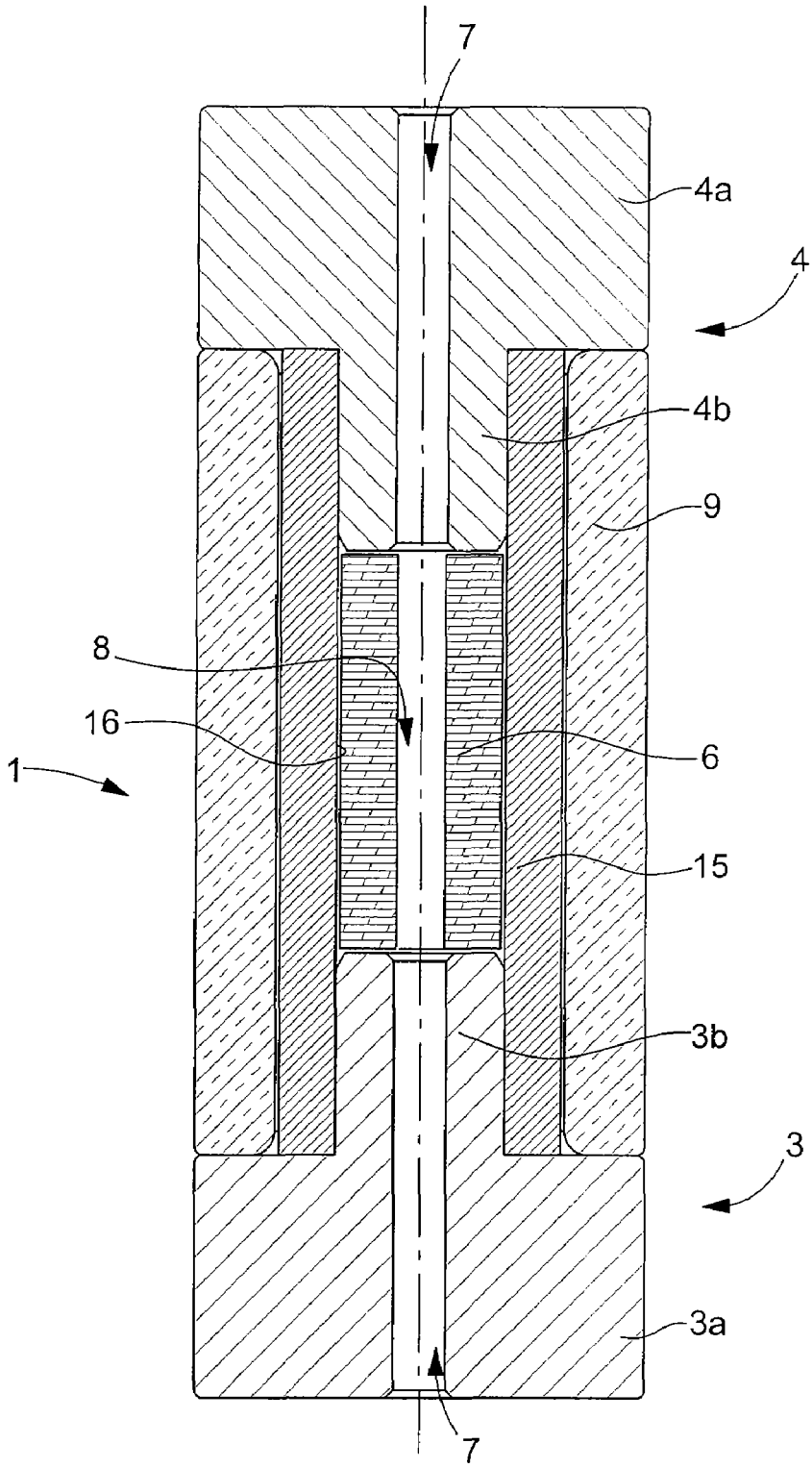
FIG. 6 is a cross-section of a link according to a second embodiment of the invention.

With reference now to FIG. 6, another embodiment is shown, which differs from those previously described in that the two caps 3, 4 are entirely identical, and in that the assembly forming a link includes an additional assembly part, namely a rigid tube 15 which surrounds feet 3*b*, 4*b* while being secured to the latter by the means previously described. The decorative part 9 is mounted with friction on said tube, i.e. without any mechanical stress on said decorative part, particularly when it is made of a fragile material such as ceramic material or glass. When decorative part 9 is made of a material capable of resisting mechanical stress, particularly assembly stress, it can form a single piece with tube 15. The length of feet 3*b*, 4*b* is such that, with the inner wall of tube 15, they form a space 16 inside which an insert 6 is arranged. In the example shown, this is a compressive insert, i.e. having a through passage 8 of smaller section than the section of connecting member 2. It is clear, without departing from the scope of the invention, that the variants of the first embodiment can be adapted to this second embodiment.

Although this second embodiment is that which comprises the largest number of pieces, it is a preferred embodiment, in particular because, as the two caps are identical, the manufacture does not require more different parts to be made, and assembly of the various parts is facilitated.

According to the invention, and for both embodiments and depending on the variants presented, each link can be assembled prior to mounting on the connecting member, or conversely the links can be positioned one by one in the following manner, taking the second embodiment by way of example:

The various constituent elements of a link 1 are made to slide over flexible connecting member 2 in the proper order, the insert being positioned at the place chosen for the link.

The cap 3 is completely engaged in rigid assembly tube 15 in order to close it.

Decorative part 9 is threaded onto the rigid tube.

Cap 4 is pressed against insert 6.

The two preceding assemblies are fitted together such that insert 6 remains positioned in the middle of the links, and particularly on the part comprising the bulge or narrow portion portion, depending upon the variant envisaged. Fitting together the various elements causes the flexible connecting member to be pinched and the link to be immobilised, or, conversely snap fits it into the insert.

When the links have to be replaced or arranged differently, the two caps need simply to be moved apart to release the central part locking the link onto the flexible connecting member.

Several other variants can be envisaged without departing from the scope of the invention, particularly one of the caps can include a deformable part on its inner face. This deformable part could for example be connected to the cap structure or formed with added complementary material.

Various cap shapes have been presented in the description of the invention. Numerous other variants exist with more or less complex configurations allowing multiple fits inside the rigid assembly tube.

Likewise, the materials used to form the caps can be very varied. However, they will preferably be chosen as a function of their aesthetic appeal and cost. Thus, for example, the use of transparent plastic could be envisaged, containing iridescent or mother-of-pearl inclusions in the form of flakes, caps coated with silver or gold paint, and a multitude of optical effects as complements to the decorative part itself.

It is also possible to provide flexible connecting members having different patterns from those explained previously. For example, one could envisage using small thermoshrinkable tubes that the user chooses to set in place, forming cylindrical thicker portions for positioning the links, instead of the bulges previously described. A large variety of materials can be used.

The dimensions of the links can vary as a function of the decorative part and the aesthetic effect desired for the necklace or the bracelet. Without departing from the scope of the invention, the diameter of the drive sheath and the length thereof can vary to a great extent.

The links shown in the various variants described are preferably cylindrical. It is however entirely conceivable to manufacture a necklace or bracelet with links of ovoid, spherical, polygonal or other shape, in accordance with the principle described in the invention.

Of course, the invention is not limited to the embodiments described and shown by way of example, but it also includes all technical equivalents and combinations thereof.

What is claimed is:

1. A necklace or bracelet formed of links threaded onto and positioned at fixed spaces on a flexible connecting member, wherein each link is formed by an assembly of parts including at least two caps, each provided with a channel respectively passing through heads and feet thereof for passage of the connecting member, and a decorative part, the caps including:

means for assembling feet to hold the decorative part between said heads, and locking means at a junction of the feet to immobilize each link at a selected location on the connecting member.

2. The necklace or bracelet according to claim 1, wherein the assembly means consist of complementary male and female parts, said male part is formed by a narrow portion of the foot and said female part by a complementary recess whose bottom includes a space formed between the feet or in the end of at least one foot to form or receive the locking means.

3. The necklace or bracelet according to claim 2, wherein the assembly means enable the caps to be secured in a manner selected from the group consisting of by bonding, by driving in, by snap fit, by screwing and by a bayonet device.

4. The necklace or bracelet according to claim 3, wherein the insert and the decorative part form a single piece able to support mechanical stress.

5. The necklace or bracelet according to claim 2, wherein the space formed between or in the feet has a larger section than the section of channel passing through the caps and wherein the flexible connecting member includes elastomeric bulges able to be forced into the channel and to be locked in the space formed between or in the feet.

6. The necklace or bracelet according to claim 2, wherein the space formed between the caps is provided to receive an insert including a through passage.

7. The necklace or bracelet according to claim 6, wherein the through passage of the insert has substantially the same section as the channel passing through the caps and includes, in the median part thereof, a recess of larger section and wherein the flexible connecting member includes elastomeric bulges able to be forced into the channel and to be locked in the recess of the insert.

8. The necklace or bracelet according to claim 6, wherein the insert is made of an elastomeric material and wherein the through passage has, over at least part of a length of the through passage, a narrow portion of smaller section than the section of the connecting member.

9. The necklace or bracelet according to claim 1, wherein the caps are identical with the feet thereof secured by means of a rigid insert tube, a space is arranged between a ring and ends of the feet to form or receive the locking means.

10. The necklace or bracelet according to claim 9, wherein the assembly means enable the caps to be secured in a manner selected from the group consisting of by bonding, by driving in, by snap fit, by screwing and by a bayonet device.

11. The necklace or bracelet according to claim 10, wherein the insert and the decorative part form a single piece able to support mechanical stress.

12. The necklace or bracelet according to claim 9, wherein the space formed between or in the feet has a larger section than the section of channel passing through the caps and wherein the flexible connecting member includes elastomeric bulges able to be forced into the channel and to be locked in the space formed between or in the feet.

13. The necklace or bracelet according to claim 9, wherein the space formed between the caps is provided to receive an insert including a through passage.

14. The necklace or bracelet according to claim 13, wherein the through passage of the insert has substantially the same section as the channel passing through the caps and includes, in the median part thereof, a recess of larger section and wherein the flexible connecting member includes elastomeric bulges able to be forced into the channel and to be locked in the recess of the insert

15. The necklace or bracelet according to claim 13, wherein the insert is made of an elastomeric material and wherein the through passage has, over at least part of a length of the through passage, a narrow portion of smaller section than the section of the connecting member.

16. The necklace or bracelet according to claim 1, wherein the decorative part is made of a brittle material, and wherein the decorative part is assembled with friction on the assembly means.

17. The necklace or bracelet according to claim 16, wherein the brittle material is selected from the group consisting of ceramic and glass.

* * * * *